US011946149B2

(12) United States Patent
Ohnishi et al.

(10) Patent No.: US 11,946,149 B2
(45) Date of Patent: Apr. 2, 2024

(54) METHOD FOR OPERATING APPARATUS FOR PRODUCING ALKALI HYDROXIDE

(71) Applicants: TOAGOSEI CO., LTD., Tokyo (JP); KANEKA CORPORATION, Osaka (JP)

(72) Inventors: Tsutomu Ohnishi, Aichi (JP); Tsugiyoshi Osakabe, Aichi (JP); Tatsurou Yamashita, Tokushima (JP); Takuya Shimura, Aichi (JP); Mikihito Sugiyama, Hyogo (JP); Yukinori Iguchi, Okayama (JP)

(73) Assignees: TOAGOSEI CO., LTD., Tokyo (JP); KANEKA CORPORATION, Osaka (JP)

( * ) Notice: Subject to any disclaimer, the term of this patent is extended or adjusted under 35 U.S.C. 154(b) by 348 days.

(21) Appl. No.: 17/520,709

(22) Filed: Nov. 7, 2021

(65) Prior Publication Data

US 2022/0056604 A1 Feb. 24, 2022

Related U.S. Application Data

(62) Division of application No. 16/313,008, filed as application No. PCT/JP2017/013702 on Mar. 31, 2017, now abandoned.

(30) Foreign Application Priority Data

Jun. 24, 2016 (JP) ..... 2016-125482

(51) Int. Cl.

| | |
|---|---|
| ***C25B 15/02*** | (2021.01) |
| ***C25B 1/16*** | (2006.01) |
| ***C25B 1/46*** | (2006.01) |
| ***C25B 9/73*** | (2021.01) |
| ***C25B 9/77*** | (2021.01) |
| ***C25B 15/021*** | (2021.01) |

(52) U.S. Cl.

CPC ..... *C25B 15/02* (2013.01); *C25B 1/16* (2013.01); *C25B 1/46* (2013.01); *C25B 9/73* (2021.01); *C25B 9/77* (2021.01); *C25B 15/021* (2021.01)

(58) Field of Classification Search

CPC .... C25B 1/16; C25B 1/34; C25B 1/46; C25B 15/02; C25B 15/021

See application file for complete search history.

(56) References Cited

U.S. PATENT DOCUMENTS 6,391,485 B1 * 5/2002 Perry ..... H01M 8/04029 429/429
2014/0096728 A1 * 4/2014 Ortenheim ..... C25B 11/02 123/3

FOREIGN PATENT DOCUMENTS

CN 205205251 U * 5/2016 ..... C25C 7/00

* cited by examiner

*Primary Examiner* — Ciel P Contreras
(74) *Attorney, Agent, or Firm* — JCIP GLOBAL INC.

(57) ABSTRACT

Apparatus for producing alkali hydroxide and method for operating apparatus for producing alkali hydroxide are provided. A cooling chamber through which a coolant can pass is constructed by placing a separation wall in a cathode chamber on a side opposite to an ion-exchange membrane, and a flow rate adjuster, such as manual valves, which can adjust the supply flow rate of the coolant is placed in each unit cell. The electrolytic temperature of each unit cell is regulated at an optimum operating temperature depending on the current density by adjusting the flow rate of the coolant without individually adjusting the flow rate of salt water supplied to the unit cell or the concentration of the salt water.

7 Claims, 8 Drawing Sheets

METHOD FOR OPERATING APPARATUS FOR PRODUCING ALKALI HYDROXIDE

CROSS-REFERENCE TO RELATED APPLICATION

This is a divisional application of patent application Ser. No. 16/313,008, filed on Dec. 22, 2018, which is a 371 application of the international PCT application serial no. PCT/JP2017/013702, filed on Mar. 31, 2017, which claims the priority benefit of Japan application no. 2016-125482, filed on Jun. 24, 2016. The entirety of each of the above-mentioned patent applications is hereby incorporated by reference herein and made a part of this specification.

TECHNICAL FIELD

The present invention relates to an apparatus for producing an alkali hydroxide in which an anode chamber having an anode and a cathode chamber having a gas diffusion electrode are separated with an ion-exchange membrane and in which electrolysis is conducted while an aqueous alkali chloride solution is supplied to the anode chamber and while an oxygen-containing gas is supplied to the cathode chamber, and the invention also relates to a method thereof.

BACKGROUND ART

A known electrolytic bath for an aqueous alkali chloride solution (salt water) in which a gas diffusion electrode is used as a cathode is "a three-chamber type" in which an anode chamber and a catholyte chamber are separated with an ion-exchange membrane and in which the catholyte chamber and a gas chamber are separated with a gas diffusion electrode in a liquid-blocking manner (PTL 1). Other proposed electrolytic baths of this type are "a two-chamber type" which enables smooth discharge of an aqueous alkali hydroxide solution generated in the electrolytic bath, smooth supply of oxygen gas to an electrode reaction surface and smooth discharge of excess gas from the bath without separating the catholyte and the oxygen gas although the anode chamber and the catholyte chamber are separated by an ion-exchange membrane (PTL 2) and the like.

In the former case, namely the three-chamber type, the temperature of the electrolytic bath can be regulated by regulating the temperature and the flow rate of the catholyte supplied to the electrolytic bath while adjusting the concentration of the alkali hydroxide discharged from the electrolytic bath by adding an appropriate amount of concentration-adjusting water to the external circulating flow of the catholyte, like the conventional hydrogen generation electrolytic baths. Moreover, PTL 1 discloses that the current efficiency of the entire electrolytic bath is improved by regulating the flow speed of the catholyte in the cathode chamber in a fixed range and thus improving the evenness of the temperature and the concentration of the catholyte inside the electrolytic bath. However, this three-chamber type has the problems concerning the durability of the electrode, namely the long-term maintenance of the liquid-blocking property of the gas diffusion electrode which separates the catholyte chamber and the gas chamber, and concerning an increase in the electrolytic voltage due to the conductive resistance of the catholyte because of the catholyte layer being between the gas diffusion electrode and the ion-exchange membrane, and these problems are issues of the practical uses.

The latter case, namely the two-chamber type, is a major electrolytic bath for producing an alkali hydroxide and chlorine gas from an aqueous alkali chloride solution using a gas diffusion electrode, because the gas diffusion electrode does not have to have the liquid-blocking function of structurally sealing the catholyte and the oxygen gas and because the structure of the electrolytic bath is simple. In the two-chamber type, however, the catholyte is not supplied to the cathode chamber from the outside, or a small amount of water or a dilute aqueous alkali hydroxide solution is supplied. Thus, it is difficult to regulate the temperature of the electrolytic bath by adjusting the supply temperature of the catholyte. When the temperature of the electrolytic bath is to be regulated by adjusting the temperature of the catholyte in a small amount, the temperature of the catholyte should be made much lower than a preferable electrolytic temperature in order to adjust the electrolytic bath at the preferable electrolytic temperature. Such an operation method has the problems of an increase in the voltage and deterioration of the product quality because the temperature inside the electrolytic bath is not even and because the electrolysis reaction surface cannot be made even.

In a two-chamber electrolytic bath to which the catholyte is not supplied from the outside, the discharge concentration of the aqueous alkali hydroxide solution generated at the cathode is determined dominantly by the amount of water which penetrates through the ion-exchange membrane with alkali metal ions from the anode chamber to the cathode side. Thus, the adjustment of the discharge concentration of the alkali hydroxide at any concentration is achieved by adjusting the amount of water which penetrates through the membrane by regulating the concentration of the anolyte depending on the coefficient of water permeability of the ion-exchange membrane.

For the above reasons, in a two-chamber gas diffusion electrode electrolytic bath, the concentration of the salt water supplied to the electrolytic bath and the flow rate of the salt water are regulated to adjust the concentration of the catholyte, and the temperature of the salt water supplied to the electrolytic bath and the flow rate of the salt water are regulated to adjust the temperature of the catholyte.

Here, when sodium chloride is electrolyzed using a gas diffusion electrode as the cathode, the operating voltage is approximately 2.0 V, while the theoretical decomposition voltage is approximately 0.96 V. When sodium hydroxide is produced by electrolyzing brine using a hydrogen generation cathode, the operating voltage, to which the overvoltage of the electrodes and the conductive resistances of the materials constituting the electrolytic bath such as the ion-exchange membrane are added, is approximately 3.0 V, while the theoretical decomposition voltage of the electrolysis reaction is approximately 2.19 V. Thus, it is advantageous to use the gas diffusion electrode when energy is to be saved. However, the voltage difference between the operating voltage and the theoretical decomposition voltage is approximately 1.04 V, which results in heat loss in view of the relation between the theoretical decomposition voltage difference and the operating current and in the action of heating the electrolytic bath.

Thus, for example, when some of the electrodes or the ion-exchange membranes have been changed during the partial maintenance of electrolytic cells which are operated in a current circuit to which electricity is supplied from a common direct current power source, the voltage changes in the new parts, or a difference arises between parts where the voltage is easily increased and parts where the voltage is not easily increased due to the change of the state of deterioration with time. Accordingly, a difference in the calorific value arises among electrolytic cells (one electrolytic cell means one set of an anode chamber and a cathode chamber) or among groups of electrolytic cells, and the operating temperatures become different.

Here, when sodium hydroxide is produced by electrolyzing brine using a hydrogen generation cathode, salt water and sodium hydroxide are supplied to the electrolytic bath, and thus, by adequately controlling their supply temperatures and flow rates, the temperature of the electrolytic bath can be controlled. On the other hand, in the two-chamber type for electrolyzing sodium chloride using a gas diffusion electrode as the cathode, the temperature of the catholyte is adjusted and the operating temperature is adjusted by regulating the temperature and the flow rate of salt water, which is the anolyte, as described above.

The concentration of the salt water supplied to an electrolytic bath and the flow rate of the salt water are regulated to adjust the concentration of the catholyte. Thus, electrolytic cells or groups of electrolytic cells can be each regulated at an appropriate temperature by regulating the temperature and the flow rate of the salt water when the operating voltages of the electrolytic baths are almost the same. In the case where the operating temperatures are different, however, the concentrations cannot be adjusted adequately when priority is given to the adjustment of the temperatures, while the temperatures cannot be adjusted adequately when priority is given to the adjustment of the concentrations. Thus, reasonable operation cannot be conducted.

Accordingly, in an actual plant having many electrolytic baths, it is required to individually adjust the salt water conditions to match the conditions of each electrolytic cell when the concentrations and the temperatures should be adjusted adequately. However, such a case is not realistic because the equipment becomes complicated and because the difficulty of the regulation is enhanced. Therefore, the conditions of the salt water supplied to the electrolytic cells or the groups of electrolytic cells should be made the same. Also, each electrolytic bath has an upper-limit temperature for the apparatus. Thus, the upper-control limit temperature is set based on the electrolytic cell (or the group of electrolytic cells) with the highest operating temperature. However, the other electrolytic cells are forced to be operated at an electrolytic temperature that is lower than the respective upper-limit temperatures, and thus the operating voltages become high due to the low electrolytic temperatures. Thus, efficient operation, namely operation with high current efficiency, cannot be conducted.

In this regard, PTL 3 proposes a structure for cooling a gas diffusion cathode-equipped electrolytic bath which has a passage that is formed in an electrolytic bath having an anode, an ion-exchange membrane and a gas diffusion cathode and that is connected to the outside of the electrolytic bath. In the structure, the conductive members constituting the electrolytic bath are cooled by passing a medium for cooling through the passage, and an excessive temperature increase due to Joule's heat is prevented. PTL 3 also proposes a cooling method in which the medium for cooling is passed through the passage by free convection or forced convection. This cooling method, however, is not a technique which can solve the problems of the invention.

REFERENCE LIST

Patent Literature

PTL 1: JP-A-2001-020088
PTL 2: JP-A-2006-322018
PTL 3: JP-A-2004-300542

SUMMARY OF INVENTION

Technical Problem

As described above, in the conventional electrolytic baths using a two-chamber gas diffusion electrode, in the case where the operating temperatures are different among the electrolytic cells or the groups of electrolytic cells, when the salt water conditions should be individually adjusted to match the conditions of each case, the equipment becomes complicated, and the difficulty of the regulation is enhanced. Moreover, when the salt water conditions are made the same, operation with high current efficiency cannot be conducted.

The invention has been made under the circumstances. The invention provides an apparatus for producing an alkali hydroxide in which the operating temperatures of the electrolytic cells or the groups of electrolytic cells are equalized and which can be operated with high current efficiency and provides a method for producing an alkali hydroxide.

Solution to Problem

The apparatus for producing an alkali hydroxide of the invention is apparatus for producing an alkali hydroxide having electrolytic cells each constructed by separating an anode chamber and a cathode chamber with an ion-exchange membrane, providing an anode in the anode chamber and providing a gas diffusion electrode in the cathode chamber and electrolysis being conducted while an aqueous alkali chloride solution is supplied to the anode chamber and while an oxygen-containing gas is supplied to the cathode chamber, the apparatus including:

the electrolytic cells, flow passages provided to each of the electrolytic cells, a coolant for cooling the electrolytic cells passing through the flow passages, and a flow rate adjuster provided to each of the electrolytic cells or each of a plurality groups of the electrolytic cells, the flow rate adjuster being able to individually adjust the flow rates of the coolant passing through the flow passages.

In the method for operating an apparatus for producing an alkali hydroxide of the invention, the apparatus has electrolytic cells each constructed by separating an anode chamber and a cathode chamber with an ion-exchange membrane, placing an anode in the anode chamber and placing a gas diffusion electrode in the cathode chamber, and electrolysis is conducted while an aqueous alkali chloride solution is supplied to the anode chamber and while an oxygen-containing gas is supplied to the cathode chamber. The method is characterized by including a step of conducting the electrolysis while the electrolytic cells are cooled by passing a coolant through flow passages, wherein each electrolytic cell has a flow passage, and a step of adjusting the flow rates of the coolant passing through the flow passages individually in each of the electrolytic cells or in a group of electrolytic cells.

Advantageous Effects of Invention

In the invention, a flow passage which is provided to each electrolytic cell, and the electrolytic cells are cooled by passing a coolant through the flow passages. Thus, the electrolytic temperatures of the electrolytic cells can be regulated at appropriate operating temperatures corresponding to the current densities without adjusting the flow rate of the aqueous alkali chloride solution (salt water) supplied to the electrolytic bath or the concentration of the salt water individually in each electrolytic cell or in each group of electrolytic cells. As a result, the temperatures of the electrolytic cells can be regulated in preferable temperature ranges, and the current efficiencies of the ion-exchange membranes can be increased.

DESCRIPTION OF EMBODIMENTS

The apparatus for producing an alkali hydroxide and the method for operating the apparatus according to embodiments of the invention described below are used for the purpose of generating an alkali hydroxide and chlorine through electrolysis and mainly used for the purpose of generating sodium hydroxide and chlorine by electrolyzing brine.

Figure 1:
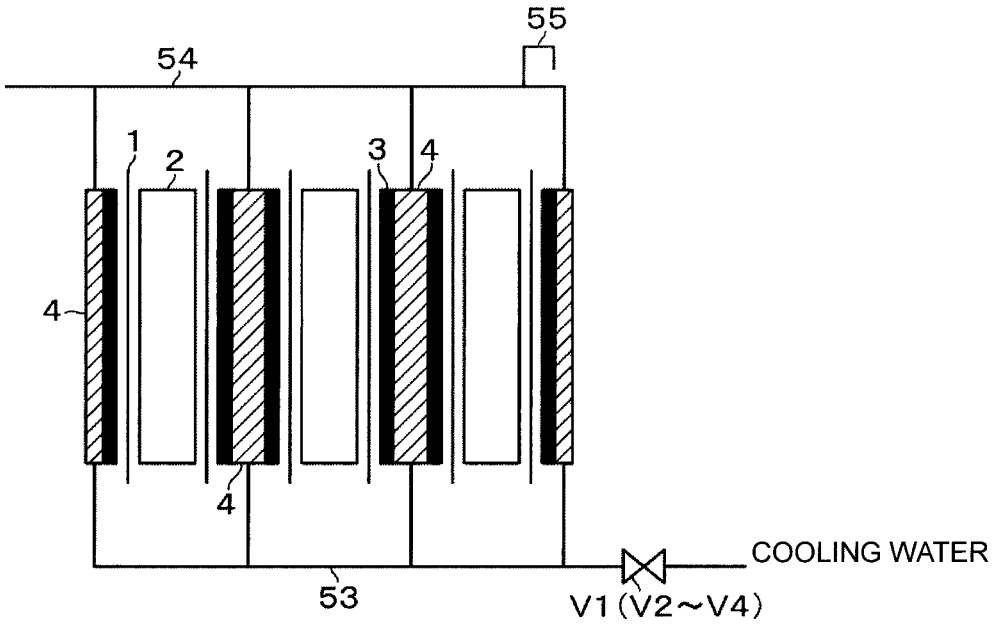
FIG. 1 is a schematic figure showing the structure of a unit cell which is one unit when the apparatus for producing an alkali hydroxide according to an embodiment of the invention is applied to a monopolar electrolytic bath.
Figure 2:
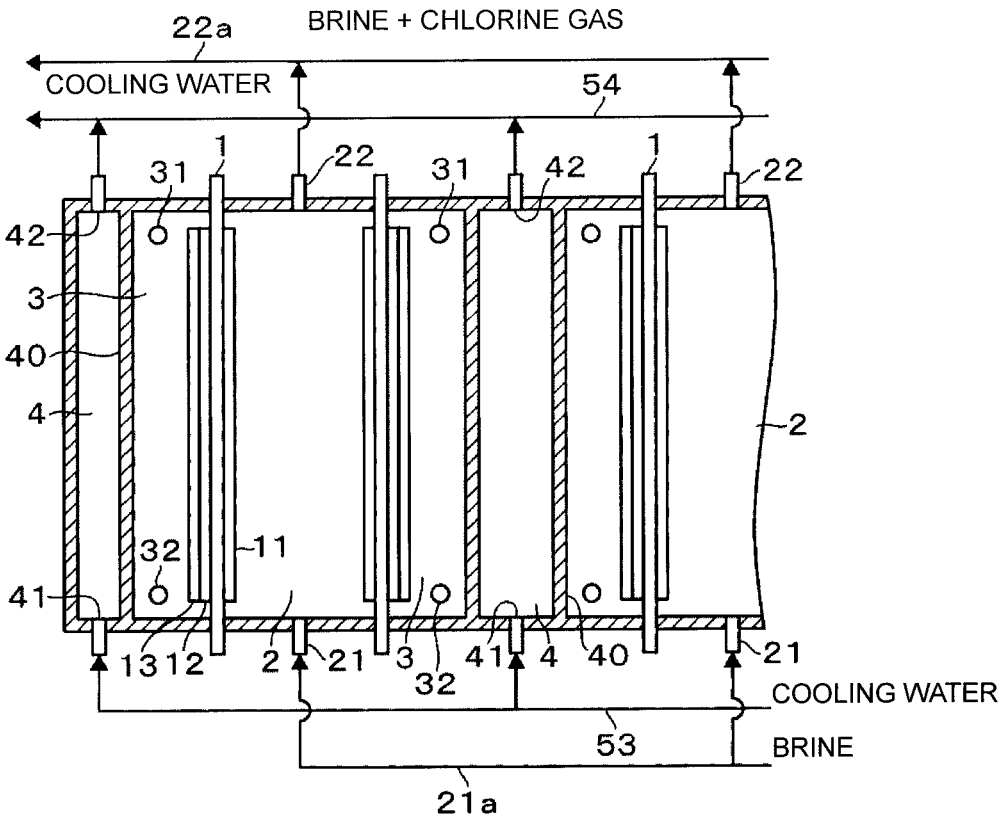
FIG. 2 is a sectional figure showing the details of the structure of the unit cell shown in FIG. 1.

FIG. 1 is a schematic figure showing a unit cell which is a component (one unit) of a monopolar electrolytic bath which is a two-chamber electrolytic bath, and FIG. 2 is a sectional figure showing the details of the partial structure of the unit cell of FIG. 1. In the unit cell, six electrolytic cells each obtained by separating an anode chamber (a white region) 2 and a cathode chamber (a black region) 3 with an ion-exchange membrane 1 are layered, and two adjacent electrolytic cells share one anode chamber 2.

As shown in FIG. 2, an anode 11 is placed on the anode chamber 2 side of the ion-exchange membrane 1, and a liquid-retaining layer 12 and a gas diffusion electrode 13 serving as the cathode are layered in this order on the cathode chamber 3 side of the ion-exchange membrane 1. An inlet 21 for salt water (a sodium chloride solution) as the anolyte is formed in the bottom surface of the anode chamber 2, and an outlet 22 for discharging brine as the anolyte and chlorine gas generated through the electrolysis reaction is formed in the upper surface of the anode chamber 2. 21*a* is a supply passage for the brine, and 22*a* is an outlet passage for the brine and the chlorine gas. The passages are each composed of a pipe.

An inlet 31 for an oxygen-containing gas is formed on the upper side of the cathode chamber 3, and a supply passage for the oxygen-containing gas, which is not shown in the figure, is connected to the inlet 31. An outlet 32 for discharging an aqueous sodium hydroxide solution, which is an aqueous alkali hydroxide solution generated through the electrolysis reaction, and excess oxygen is formed on the bottom side of the cathode chamber 3, and an outlet passage for the aqueous sodium hydroxide solution and excess oxygen, which is not shown in the figure, is connected to the outlet 32.

A cooling chamber 4 (a region with slant lines in FIG. 1) which forms a flow passage through which cooling water as a coolant passes is placed on the back-surface side of the wall facing the ion-exchange membrane 1 across the cathode chamber 3. In other words, a separation wall 40 (see FIG. 2) is placed in the frame constituting the cathode chamber 3, which is conductive and in which the gas diffusion electrode 13, a current collector, an elastic material and the like are arranged, on the side opposite to the ion-exchange membrane 1 seen from the cathode chamber 3. The separation wall 40 constitutes a region separated from the cathode chamber 3 as the cooling chamber 4. The material of the separation wall 40 is preferably a high nickel alloy material in view of the resistance to corrosion, the conductivity and the costs, and SUS310S, pure nickel and the like are preferable materials. When an electrolytic bath equipped with hydrogen generation cathodes is converted into a gas diffusion two-chamber electrolytic bath, the rigid mesh material attached in parallel to the electrolysis surface as a material constituting a cathode of the hydrogen generation electrolytic bath can be used for reinforcing the bend of the separation wall 40. In this case, the structural strength is enhanced. Moreover, because the coolant on the back surface of the separation wall 40 directly touches the rigid mesh material, the effect of enlarging the effective heat transfer area is obtained, and the thermal conductivity can be increased.

A cooling water inlet 41 and a cooling water outlet 42 are formed at the bottom and on the upper surface of each cooling chamber 4, respectively.

Figure 3:
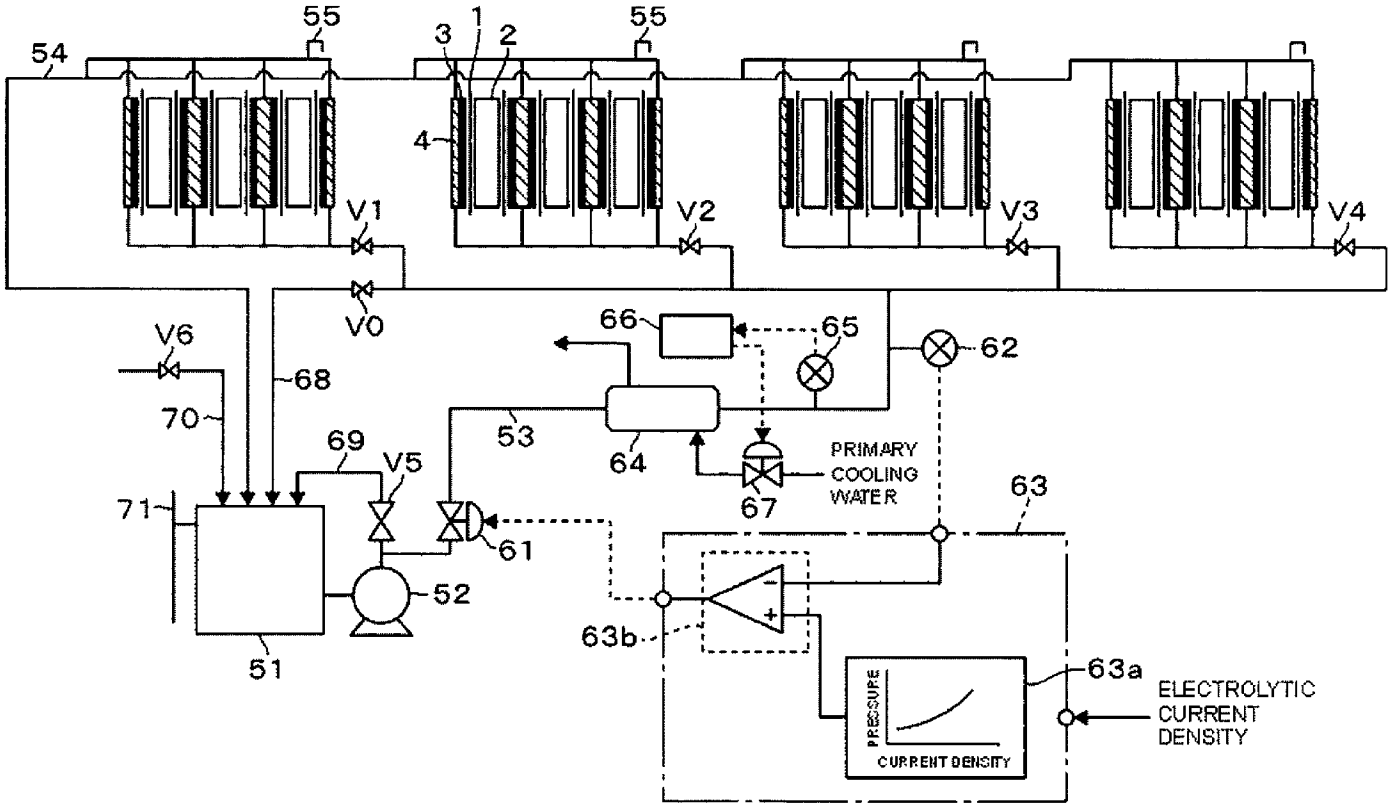
FIG. 3 is a schematic figure showing the structure of an apparatus for producing an alkali hydroxide including a monopolar electrolytic bath having unit cells of the type shown in FIG. 1.
Figure 4:
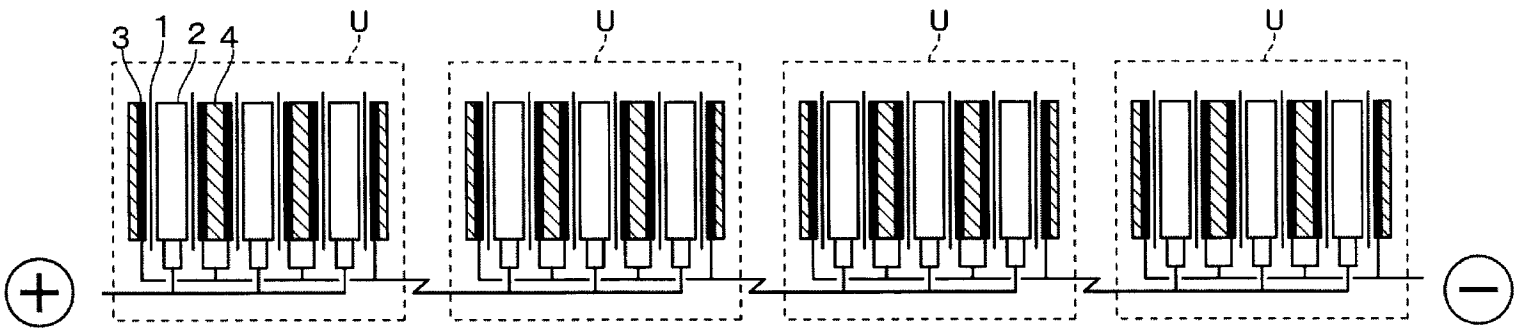
FIG. 4 is a figure explaining the electric circuit of the monopolar electrolytic bath shown in FIG. 1.

FIG. 3 shows a structure in which the invention is applied to a monopolar electrolytic bath composed of a plurality of, for example four, unit cells of the type shown in FIG. 1. As shown in FIG. 4, the six electrolytic cells constituting a unit cell are connected in parallel to each other and to a direct current power source, and the four unit cells are connected in series. The symbols U's in FIG. 4 each indicate a unit cell of the type shown in FIG. 1, and the symbols "+" and "−" indicate the positive electrode and the negative electrode of the direct current power source, respectively.

When the part for supplying cooling water to the electrolytic cells is called a cooling system here, the cooling system has a cooling water tank 51, a circulation pump 52 and a cooling water supply passage 53 and a cooling water recovery passage 54 which are each composed of a pipe as shown in FIG. 3. The cooling water supply passage 53 is branched into four passages to distribute the cooling water sent from the cooling water tank 51 to the unit cells. Manual valves V1 to V4 which are flow rate-adjusting valves for adjusting the flow rates of the cooling water supplied to the four unit cells independently (individually) are placed in the four branch passages. The cooling water recovery passages 54 connected to the cooling water outlets 42 of the six electrolytic cells constituting a unit cell meet and form a combined passage, and the four combined passages of the unit cells meet and are connected to the cooling water tank 51.

In the cooling water supply passage 53, a cooling-water-pressure-adjusting valve (simply called a pressure-adjusting valve below) 61 and a cooling water pressure gauge (simply called a pressure gauge below) 62 are placed in this order from the upper stream at an upstream part of the part at which the cooling water supply passage 53 is branched corresponding to the unit cells. The degree of opening of the pressure-adjusting valve 61 is adjusted by a first controller 63, and the pressure of the cooling water is thus regulated.

As shown in FIG. 3, the first controller 63 has, for example, a function generator 63*a* which defines the relation between the set pressure value of the cooling water and the electrolytic current density and an adjuster 63*b* which outputs a controlled amount based on the difference between the set pressure value output from the function generator 63*a* and the pressure value measured by the pressure gauge 62, for example, through PID calculation. In other words, the function generator 63*a* is an output unit which outputs a set pressure value based on the electrolytic current density. The electrolytic current density which is input into the function generator 63*a* is a value obtained by dividing the value of current flowing in all the four unit cells (the unit cells indicated by the symbols U's in FIG. 4) described above, namely the detected value of the current supplied to the four unit cells from the direct current power source (the current detector is not shown in the figure), by the entire electrode area (the entire area of the anodes 11) of one unit cell. Here, the function generator 63*a* and the adjuster 63*b* of the first controller 63 may be hard components or software. When the function generator 63 is software, two or more sets of the set pressure value of the cooling water and the electrolytic current density are input into a memory, and a graph is drawn by interpolating the input data with a program. The relation between the set pressure value of the cooling water and the electrolytic current density will be described in detail in the section explaining the function.

A heat exchanger 64 is placed between the pressure-adjusting valve 61 and the pressure gauge 62 in the cooling water supply passage 53, and a cooling water thermometer 65 is placed in a downstream part of the heat exchanger 64. 66 is a second controller. By adjusting the supply amount of the primary cooling water to the heat exchanger 64 with a flow rate-adjusting valve 67 placed in the flow passage of the primary cooling water based on the temperature value detected by the cooling water thermometer 65 and the set temperature value (set temperature), the temperature of the cooling water supplied to the unit cells is adjusted to the set temperature.

A bypass passage 68 which is composed of a pipe and which makes a detour around the four unit cells and returns to the tank 51 is connected to the cooling water supply passage 53 at a downstream part of the pressure gauge 62. The bypass passage 68 also serves as a flow passage to let the cooling water out of the unit cells. 69 is a circulation passage of the cooling water tank 51, and 70 is a supply passage for supplemental cooling water for adding cooling water to the cooling water tank 51. 71 is an overflow, and V0, V5 and V6 are valves.

In some cases, depending on the flow rate of the cooling water, the pressures applied to the separation walls 40 and the like in the cathode chambers 3 change due to siphonage caused by the downflow of the cooling water, or the cooling water comes out. Thus, siphon breakers 55 are desirably attached to the cooling water recovery passages 54 at a part higher than the unit cells.

Figure 5:
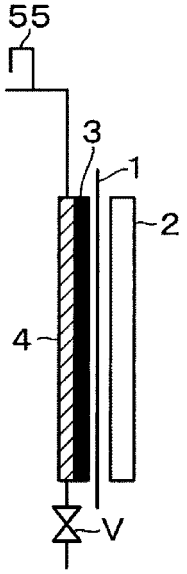
FIG. 5 is a schematic figure showing the structure of a unit cell which is one unit when the apparatus for producing an alkali hydroxide according to an embodiment of the invention is applied to a bipolar electrolytic bath or to a single-element electrolytic bath.
Figure 6:
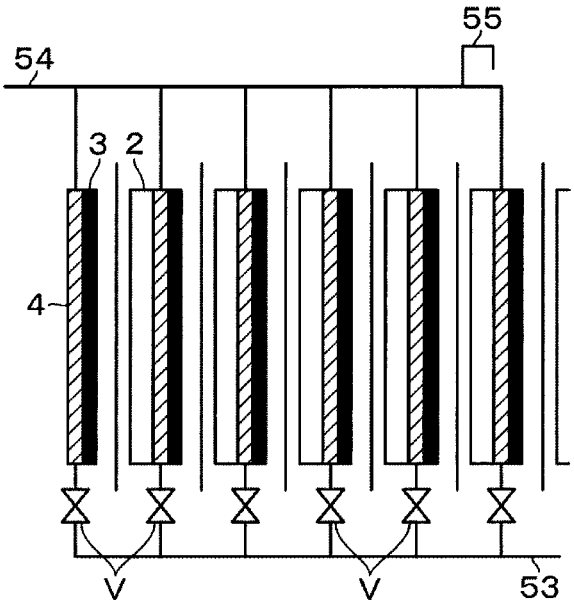
FIG. 6 is a schematic figure of a bipolar electrolytic bath or a single-element electrolytic bath in which unit cells of the type shown in FIG. 5 are layered.

Next, the structure of an apparatus in which the invention is applied to a bipolar electrolytic bath or to a single-element electrolytic bath is described. FIG. 5 is a schematic figure showing a unit cell which is a component (one unit) of a bipolar electrolytic bath or a single-element electrolytic bath, and FIG. 6 shows a structure in which six unit cells of the type shown in FIG. 5 are layered. As described above, because the electrolytic cells are connected in parallel in the current circuit of a monopolar electrolytic bath, there is one manual valve for individually adjusting the flow rate of the cooling water sent to one unit cell (any of V1 to V4). On the other hand, because the electrolytic cells are connected in series in the current circuit of a bipolar electrolytic bath or a single-element electrolytic bath, the unit shown in FIG. 6, for example, has six unit cells. Thus, six manual valves each for adjusting the flow rate of cooling water individually are described. The respective manual valves which are the flow rate-adjusting valves provided for the six unit cells are each given a symbol V in order to avoid any complicated description.

Figure 7:
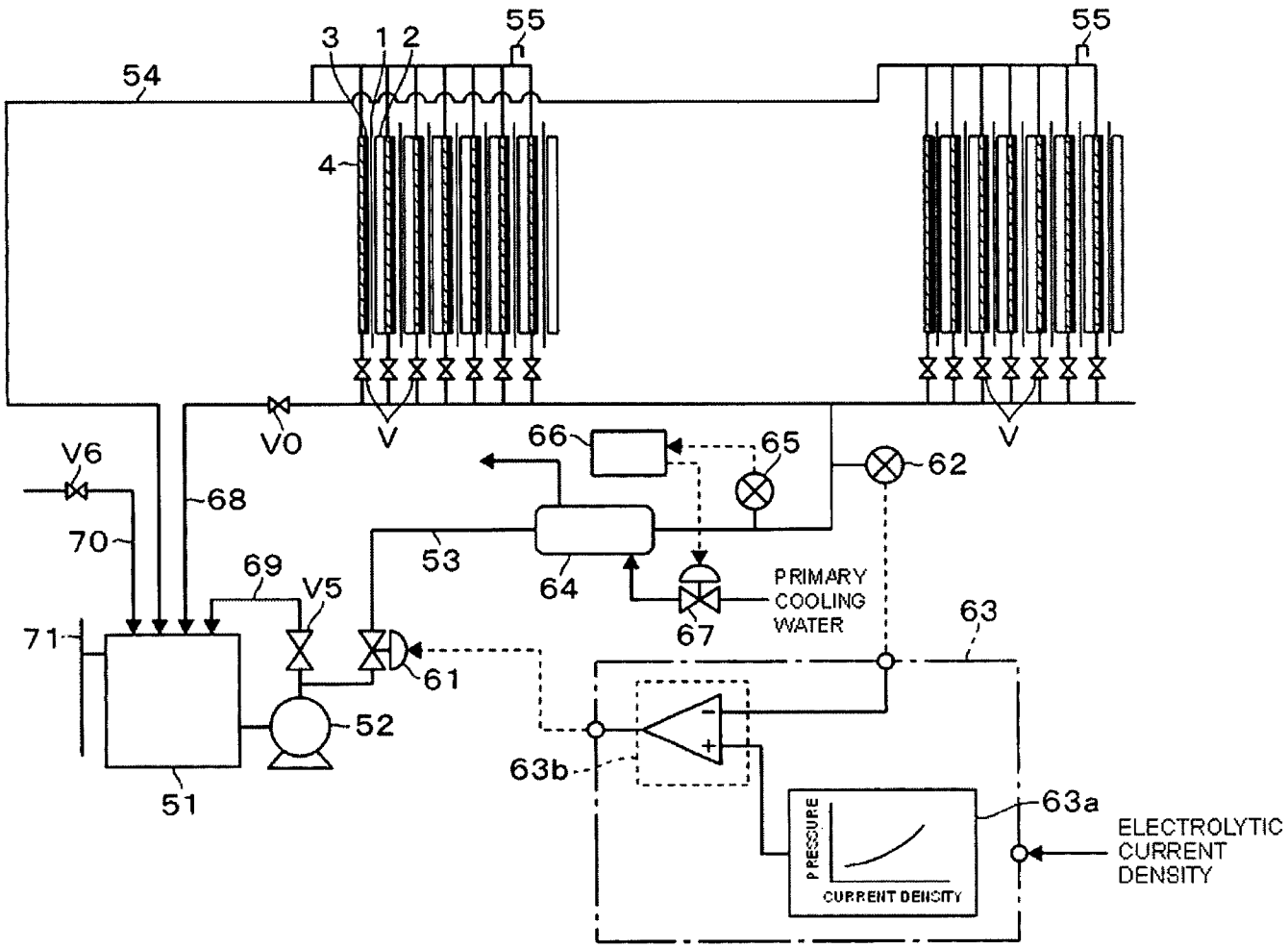
FIG. 7 is a schematic figure showing the structure of an apparatus for producing an alkali hydroxide composed of a plurality (two sets for example) of connected electrolytic baths of the type shown in FIG. 6.

The structure of the flow of the cooling water in a unit cell is similar to the structure shown in FIG. 2, and the cooling chamber 4 is placed on the back-surface side of the separation wall 40 which is a wall facing the ion-exchange membrane 1 across the cathode chamber 3. In FIG. 7, two layered structures each having six unit cells of the type shown in FIG. 6 are used, and a cooling system similar to that shown in FIG. 3 is combined. In FIG. 7, the parts corresponding to those of FIG. 3 are given the same symbols. In this regard, the two layered structures each having six unit cells are electrically connected in series.

Similar effects can be expected in the case of attaching one siphon breaker 55 to each unit cell (FIG. 5, for example) and in the case of attaching one siphon breaker 55 to each layered structure (FIG. 6, for example). The siphon breakers 55 are attached at required sites, but one siphon breaker 55 is preferably provided for each layered structure in view of the management.

Ion-exchanged water having electrical conductivity of 10 microsiemens or less is preferably used as the coolant, and the stray current from a unit cell can be prevented from leaking to the outside when such a coolant is used. It is preferable to provide a measuring unit for continuously measuring at least one of the pH and the electrical conductivity of the coolant circulating through the flow passages of the electrolytic cells. With the measuring unit, a decrease in the cleanliness of the coolant or the presence or absence of contamination of the coolant with the electrolyte due to the breakage of the separation wall in an electrolytic cell or the like can be monitored.

Next, a method for operating the apparatus for producing an alkali hydroxide shown in FIG. 3 or FIG. 7 is described. First, a brief description of electrolysis reaction is as follows. An electrical current is applied to each electrolytic cell. Then, brine is supplied to the anode chamber 2, and a gas containing oxygen is supplied to the cathode chamber 3 at the same time. Water containing sodium ions exudes from the liquid-retaining layer 12 retaining an aqueous sodium hydroxide solution to the gas diffusion electrode 13 and reacts with oxygen in the cathode chamber 3 to generate an aqueous sodium hydroxide solution. Also, chlorine ions in the brine turn into a chlorine gas in the anode chamber 2 and are discharged with the brine.

Cooling water is supplied to the electrolytic cell (unit cell) by the cooling system, and the electrolytic cell is thus cooled. It is preferable to supply the cooling water to the unit cell at a sufficient flow rate, make the difference in temperature between the cooling water inlet 41 and the cooling water outlet 42 small and remove heat evenly from the electrolysis surface. It is preferable to flood and pass water through the electrolytic cell from the bottom to the top because the cooling water can be supplied to the electrolytic cell at a high cooling water flow rate.

When the internal temperature of the electrolytic cell (the temperature of the anode chamber 2 or the surface temperature of the cathode) and the temperature of the cooling water are too close, the heat transfer efficiency decreases, and the evenness of the internal temperature of the electrolytic bath is enhanced. Thus, the temperature difference between the internal temperature of the electrolytic bath and the supply temperature of the cooling water is preferably 5° C. to 60° C., more preferably 10° C. to 40° C., further preferably 10° C. to 25° C. The temperature difference between the temperature of the anode chamber 2 and the temperature of the cooling water outlet 42 is preferably 1° C. or more, more preferably 3° C. or more.

The temperature of the cooling water is set in the temperature range for the purpose of making the temperature difference from the internal temperature of the electrolytic cell small to make the current distribution of the electrolytic cell excellent. For example, a preferable example of the temperature of the anode chamber 2 of the electrolytic cell is 70 to 90° C. In the case of 85° C. for example, because the most preferable range of the temperature difference from the supply temperature of the cooling water is 25 to 10° C., the supply temperature of the cooling water is set in the range of 60 to 75° C. When the temperature of the cooling water outlet 42 is around the temperature of the anode chamber 2, the cooling efficiency deteriorates, and thus the flow rate is determined in a manner that an adequate outlet temperature is obtained during high current density operation with a heavy heat load. The value of the high current density operation with a heavy heat load is the maximum value in the determined operating range, and examples of the maximum value of the operating range are values of 3 $kA/m^2$, 7 $kA/m^2$ and the like.

The supply temperature of the cooling water is adjusted at an appropriate temperature by setting the set temperature value of the second controller 66 at a value selected in the temperature range described above, for example, and adjusting the flow rate of the primary cooling water with the flow rate-adjusting valve 67 in a manner that the temperature value detected by the thermometer 65 becomes the set temperature value.

The flow rates of the cooling water to the unit cells are adjusted by an operator depending on the respective operating voltages of the unit cells using manual valves which are individual flow rate-adjusting valves. The manual valves are "V1 to V4" in the apparatus shown in FIG. 3 and are "V's" in the apparatus shown in FIG. 7. The timing of adjusting the manual valves is, for example, after starting the first operation, after starting operation after the maintenance or the change of the electrodes or the ion-exchange membranes in the electrolytic bath or the like.

Accordingly, the cooling water is supplied at a relatively high flow rate to a unit cell in which the operating voltage becomes high and in which the temperature(s) of the electrolytic cell(s) is increasing, while the cooling water is supplied at a relatively low flow rate to a unit cell in which the operating voltage becomes low and in which the temperature(s) of the electrolytic cell(s) is decreasing. Therefore, the temperature difference among the unit cells can be kept small.

Figure 8:
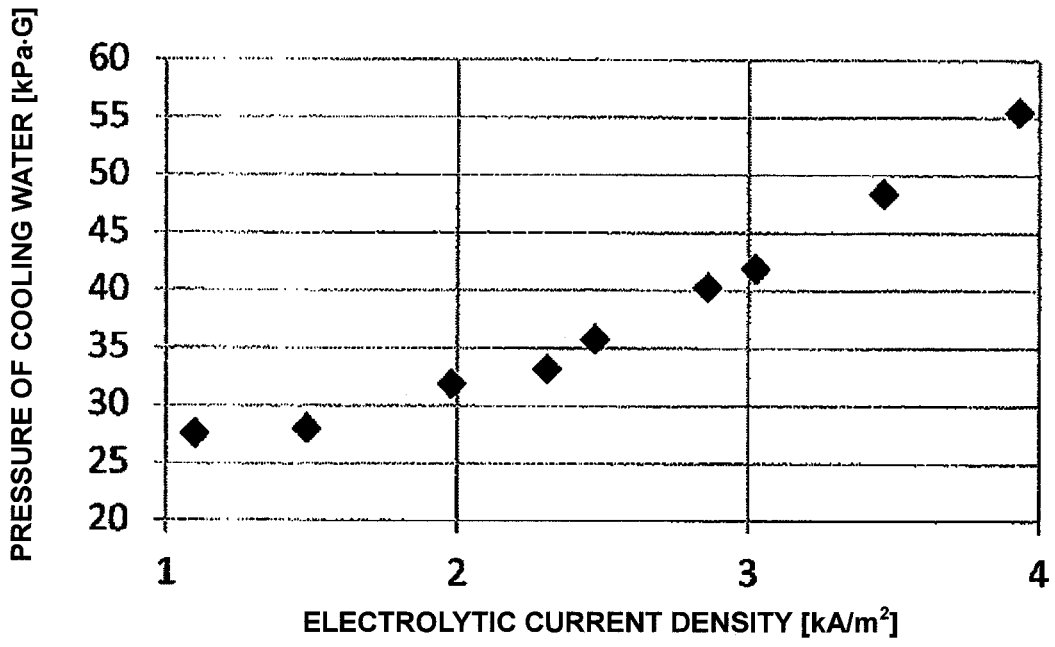
FIG. 8 is a graph showing the relation between the electrolytic current density and the pressure of the cooling water of a test apparatus in which the electrolytic cells are cooled using the cooling system shown in FIG. 3 or FIG. 7.

Next, the regulation of the pressure of the cooling water by the first controller 63 is explained. FIG. 8 is a graph showing the relation between the electrolytic current density and the pressure of the cooling water in the case of conducting cooling regulation using a test apparatus having one electrolytic cell and the regulation system shown in FIG. 3. The relation between the electrolytic current density and the pressure of the cooling water (an example is shown in FIG. 8) is input in advance into the function generator 63*a* of the first controller 63. The relation is input in a manner that the minimum area of the operating range of the electrolytic current density is ignored and that the ratio of the flow rate of the cooling water to the electrolytic current density becomes constant or the ratio of the flow rate of the cooling water to the electrolytic current density gradually increases in the range from ⅓ or ½ of the maximum electrolytic current density to the maximum electrolytic current density. The relation between the electrolytic current density and the pressure of the cooling water is preferably determined by an experiment in advance, and the maximum pressure value of the cooling water should be the maximum pressure which can be applied to the electrolytic cell cooling water part or smaller. In the case of the example of FIG. 8, this is an example in which the set pressure value of the cooling water at 4.0 $kA/m^2$ is approximately 56 kpa/G, which is almost the maximum pressure, when the maximum pressure that can be applied to the cooling water part is 60 kpa/G and the maximum value of the operating range of the electrolytic current density is 4.0 $kA/m^2$, and this is an example in which the cooling water amount increases in the range from 1.3 $kA/m^2$, which is ⅓ of the maximum electrolytic current density, or from 2 $kA/m^2$, which is ½, to 4 $kA/m^2$ (FIG. 9).

Figure 9:
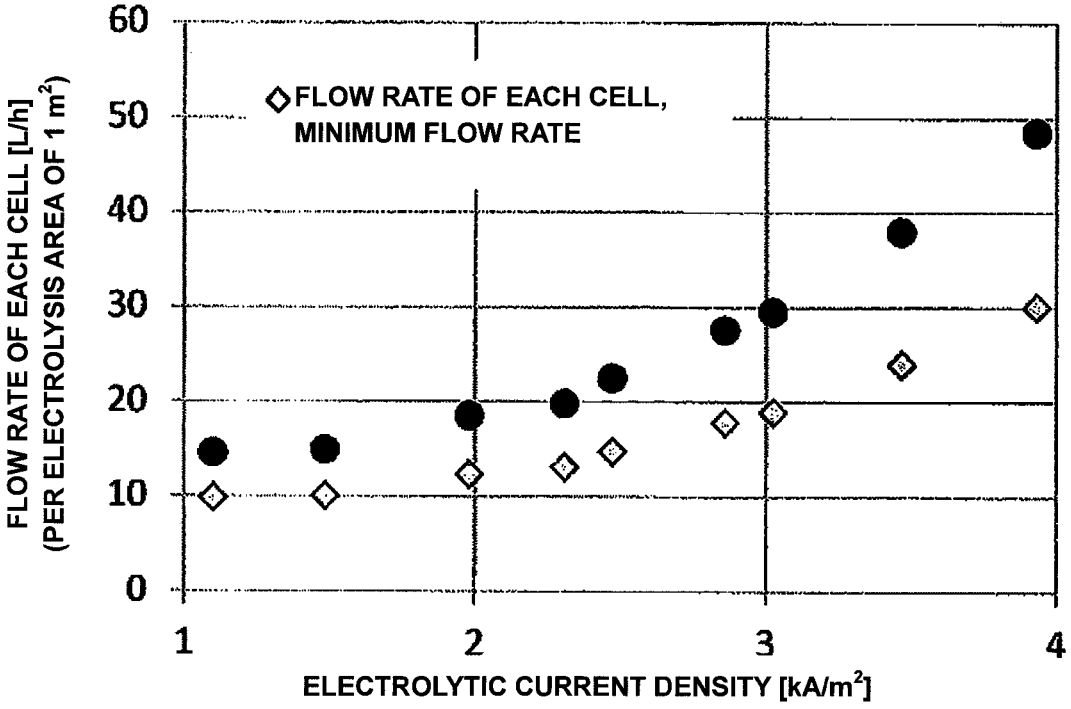
FIG. 9 is a graph showing the relation between the electrolytic current density and the flow rate of the cooling water of a test apparatus in which the flow rate of the cooling water can be adjusted independently in each of electrolytic cells having the cooling system shown in FIG. 3 or FIG. 7.

FIG. 9 is a graph showing the relation between the electrolytic current density and the flow rate of the cooling water of a test apparatus in which six electrolytic cells are used and in which the flow rate of the cooling water can be adjusted independently in each electrolytic cell, and the graph shows the data of an electrolytic cell with the maximum flow rate of the cooling water and of an electrolytic cell with the minimum flow rate. From FIG. 8 and FIG. 9, it can be seen that, since the temperature of an electrolytic cell increases as the electrolytic current density increases, the action of cooling is exerted to inhibit the temperature increase.

In a method for adjusting the supply flow rates of the cooling water individually to each the unit cell, the supply flow rates are determined, for example, based on the subject to be cooled in which the water amount should be the lowest (an electrolytic cell with the lowest operating electrolytic temperature or the like). In this case, the degree of opening of the flow rate adjuster (any of the manual valves indicated by V1 to V4 and V's in the above examples) for the subject to be cooled with the lowest flow rate of the cooling water is adjusted to a degree of opening resulting in the lowest target flow rate under the operating conditions under which the cooling load becomes the lightest. Regarding the other unit cells which are the subjects to be cooled in which the flow rates should be increased one by one, the degrees of opening are adjusted in a manner that the flow rates correspond to the respective operating temperatures. In this case, the point at which a degree of opening becomes the full opening is the limit of cooling under the operating electrolysis conditions.

On the contrary, in an example in which the flow rates of the cooling water to the subjects to be cooled (unit cells) are individually adjusted based on a unit cell which is the subject to be cooled which should be cooled the most, the degree of opening of the flow rate adjuster of the unit cell to which the highest amount of cooling water should be sent is made full opening under the operating conditions under which the cooling load becomes the heaviest, and the flow rates of the unit cells which are the subjects to be cooled in which the required cooling loads are light are adjusted one by one by the degrees of opening. When a degree of opening is made totally closed, this does not contribute to cooling. Thus, a degree of opening at which the flow rate reaches the minimum control value is the lower limit of the adjustment. The minimum control flow rate relates to the speed of response to the temperature change of the unit cell due to a change in the electrolytic current density. It is necessary to make the flow rate high when the speed of the change in the electrolytic current density is high, but the flow rate can be made almost zero when the speed is low. A flow rate at which the cooling water is replaced in approximately 10 minutes to two hours is desirably selected.

As described above, the resistances of the cooling water inlets 41 of the unit cells, which are the subjects to be cooled, are each adjusted in a manner that the difference in the calorific value due to the difference in the electrolytic voltage disappears, and the supply pressures of the cooling water are regulated in a manner that the change in the total flow rate of the cooling water is in proportional to the electrolytic current density.

When the temperature of the coolant supplied to the cooling chamber 4 is regulated, for example, at 60° C. or higher during the heating operation of the electrolytic bath (the term here is not used in the context of classification of electrolytic cells or unit cells but is used as a general term meaning a bath for conducting electrolysis) before applying an electrical current, the temperature of the electrolytic bath can be increased quickly to the temperature suitable for the current application, and thus the preparation period for the current application can be shortened.

When the operation of the electrolytic bath is stopped by shutting off the current, the supply of the coolant is continued, and at the same time the supply temperature of the coolant to the electrolytic bath is regulated at 60° C. or lower. In this manner, the temperature of the electrolytic bath can be decreased quickly, and the materials constituting the electrolytic bath can be prevented from deteriorating due to the electromotive force caused by the potential difference between the electrodes after the electrolytic bath stops.

In the above embodiments, the cooling water is supplied to each unit cell, and the flow rate of the cooling water to each unit cell is adjusted individually depending on the operating voltage. In an electrolytic bath using two-chamber gas diffusion electrodes operated in one current circuit, the electrolytic temperatures are not the same because of the difference in the voltage properties among the unit cells constituted with ion-exchange membranes or the like. In the above embodiments, supply of salt water to all the anodes of the electrolytic bath to which the salt water is supplied is regulated under the same concentration and temperature conditions, while selective cooling regulation is conducted. Thus, efficient operation which equalizes the electrolytic temperatures can be conducted.

By regulating the temperatures of the unit cells in the preferable temperature range, the current efficiency and the durability of the ion-exchange membranes can be enhanced, and the concentration of the chloride ions in the sodium hydroxide solution generated at the cathodes can be decreased.

Although a manual valve is used to individually adjust the flow rate of the cooling water in each unit cell in the above examples, an automatic flow rate-regulating valve may be used instead of the manual valve. For example, it is possible to detect the operating voltage or the temperature of the unit cell and conduct automatic regulation by the automatic flow rate-regulating valve based on the detected value. When the costs of the apparatus should be kept low, however, it is advantageous to adjust the flow rate manually. Thus, in the method for supplying the cooling water, the supply pressure of the cooling water is changed depending on the operating electrolytic current as shown in FIG. 3 and FIG. 7, and the flow rate of the cooling water to the cooling chamber 4 of each unit for regulation of the flow rate is controlled by adjusting the degree of opening of the manual valve or the like to adjust the distribution. By such a method, the temperature of the electrolytic bath can be adjusted inexpensively and highly precisely.

The unit for individual regulation of the flow rate of the cooling water is not limited to the unit of unit cell described above but may be an electrolytic cell or a group of electrolytic cells depending on the state of deterioration of the equipment or the like.

The invention can be applied not only to an apparatus in which all the unit cells are operated in one current circuit, namely an apparatus operated in a current circuit to which electricity is supplied from a common direct current power source, but also to an apparatus in which a direct current power source is provided for each unit cell or for each group of unit cells.

Examples in which the coolant sent to each cooling chamber is water or air include a) an air cooling method through natural airing in which air comes in from the bottom and goes out from the top through top and bottom holes, b) an air cooling method in which air is forcibly sent with a blower or the like, c) a method in which water mist is added to a method in which air is forcibly sent, d) a method in which water is sprayed and e) a method in which cooling water is passed.

The quantity of removed heat increases in the above order. a) and b) have small effects, and c), d) and e) are preferable examples. In c) and d), water is preferably supplied from the top of the electrolytic bath and removed from the bottom for the purpose of making the discharge of the water easy. In c), however, it is difficult to make the supply amount of water high, and the effect of removing heat is limited. d) has an advantage in that water does not easily leak even when the sealing structure is simple because almost no water pressure is applied to the cooling chamber. However, when the amount of the cooling water is low, the quantity of removed heat is small, or a difference in the quantity of removed heat arises easily between the upper part and the lower part. Thus, a large amount of cooling water is used for evenly removing heat from the electrolysis surface, and it is required to make the sealing structure of the cooling chamber strong. Because the temperature difference between the inlet and the outlet of the cooling water can be made small with a sufficient flow rate of the cooling water, the method e) is preferable to evenly remove heat from the electrolysis surface, and it is preferable to flood and pass water through the electrolytic cell from the bottom to the top to increase the flow rate of the cooling water.

EXAMPLES

Example 1

The electrolytic cells used for the test were DCM-type electrolytic baths manufactured by Chlorine Engineers Ltd. which were converted into a gas diffusion electrode method type. The original electrolytic baths each used an electrode having active carbon supported on stainless mesh as the hydrogen generation electrode. When the electrolytic baths were each converted into the gas diffusion electrode method type, a separation wall for a gas chamber and a cooling water chamber was provided on the electrode by welding, and a cooling structure was formed in the cathode chamber. The ion-exchange membranes were Aciplex F-4403D manufactured by Asahi Kasei Chemicals Corporation. The gas diffusion electrodes as the cathodes were GDE-2008 manufactured by Permelec Electrode Ltd., and the anodes used were DSE manufactured by Permelec Electrode Ltd. The operating conditions of the salt water and the cooling water supplied to each electrolytic cell (unit) and the like are shown below, and the operating conditions described are per effective electrolysis area. From such electrolytic cells, six electrolytic cells having electrodes and ion-exchange membranes with different degrees of deterioration were prepared. The electrolytic cells were arranged in a manner that the electrodes of each electrolytic cell were connected in series and that the cooling water could be supplied independently to each electrolytic cell. Conditions under which a difference in the electrolytic voltage would arise among the electrolytic cells (unit cells) were thus set.

Two kinds of current density conditions were set. Cooling regulation was conducted in each case (current density), and the property of controlling the unit cells (electrolytic baths) was examined. Salt water and an oxygen gas were supplied to the six unit cells each at the same temperature and at the same flow rate. The temperature of a unit cell was represented by the temperature of the anode chamber.

The supply conditions of the salt water to the unit cells and the like are shown in Table 1 as the other conditions. The maximum temperature differences among the unit cells without cooling were each estimated by calculating the heat balance difference calculated from the difference in the electrolytic voltage (the difference between the unit cell with the highest voltage and the unit cell with the lowest voltage) as the temperature difference and ignoring the decrease in the voltage due to the increase in the temperature. The results of the calculation are shown in Table 1.

TABLE 2

| | | Salt water supplied to unit cells | | | Cooling water supplied to unit cells | | Conditions of unit cells | | Temperature | Without cooling | |
|---|---|---|---|---|---|---|---|---|---|---|---|
| | Current density [kA/m$^2$] | Flow rate [L/(h · m$^2$)] | Temperature [° C.] | Concentration [g/L] | Flow rate [L/( h · m$^2$)] | Temperature [° C.] | Voltage [V] | Anode chamber temperature [° C.] | difference among unit cells [° C.] | Maximum electrolytic bath temperature [° C.] | Maximum temperature difference among unit cells [° C.] |
| Example 2 | 1.71 | 23.8 | 59.0 | 261 | 6.9 | 64.8 | 1.89 | 82.0 | 0.3 | 89.6 | 7.6 |
| | | | | | 15.1 | 64.8 | 1.97 | 81.9 | | | |
| | | | | | 6.9 | 64.8 | 1.88 | 82.0 | | | |
| | | | | | 6.9 | 64.8 | 1.88 | 82.0 | | | |
| | | | | | 15.1 | 64.8 | 1.96 | 81.8 | | | |
| | | | | | 8.3 | 64.8 | 1.92 | 82.0 | | | |
| | 2.75 | 39.7 | 45.4 | 261 | 12.4 | 65.0 | 2.09 | 85.7 | 0.6 | 95.8 | 10.1 |
| | | | | | 35.8 | 65.0 | 2.22 | 86.3 | | | |
| | | | | | 12.4 | 65.0 | 2.09 | 85.8 | | | |
| | | | | | 12.4 | 65.0 | 2.09 | 85.7 | | | |
| | | | | | 35.8 | 65.0 | 2.20 | 86.3 | | | |
| | | | | | 22.0 | 65.0 | 2.15 | 86.0 | | | |

Example 2

A test similar to that of Example 1 was conducted using the same apparatus as that of Example 1 except that the conditions of the supplied salt water such as the flow rate and the concentration were changed and two kinds of current density conditions were set. The results are shown in Table 2.

TABLE 1

| | | Salt water supplied to unit cells | | | Cooling water supplied to unit cells | | Conditions of unit cells | | Temperature | Without cooling Maximum | Maximum temperature |
|---|---|---|---|---|---|---|---|---|---|---|---|
| | Current density [kA/m$^2$] | Flow rate [L/(h · m$^2$)] | Temperature [° C.] | Concentration [g/L] | Flow rate [L/(h · m$^2$)] | Temperature [° C.] | Voltage [V] | Anode chamber temperature [° C.] | difference among unit cells [° C.] | electrolytic bath temperature [° C.] | difference among unit cells [° C.] |
| Example 1 | 1.92 | 42.2 | 56.0 | 244 | 8.3 | 65.0 | 1.94 | 82.6 | 0.5 | 86.9 | 4.1 |
| | | | | | 19.3 | 65.0 | 2.02 | 83.0 | | | |
| | | | | | 8.3 | 65.0 | 1.93 | 82.8 | | | |
| | | | | | 8.3 | 65.0 | 1.93 | 82.9 | | | |
| | | | | | 19.3 | 65.0 | 2.01 | 83.1 | | | |
| | | | | | 13.8 | 65.0 | 1.97 | 82.9 | | | |
| | 2.58 | 50.4 | 47.3 | 244 | 12.4 | 65.0 | 2.07 | 85.2 | 0.6 | 91.5 | 6.2 |
| | | | | | 27.5 | 65.0 | 2.18 | 85.8 | | | |
| | | | | | 12.4 | 65.0 | 2.06 | 85.3 | | | |
| | | | | | 12.4 | 65.0 | 2.06 | 85.3 | | | |
| | | | | | 27.5 | 65.0 | 2.17 | 85.8 | | | |
| | | | | | 19.3 | 65.0 | 2.11 | 85.5 | | | |

As it is seen from Table 1, the differences in the quantity of heat which arose from the differences in the voltage were removed by the cooling regulation action of the cooling water, and the temperature differences could be controlled to be small values as shown in the column of the temperature difference among the unit cells. As it is seen from Table 2, this control can be applied even when the flow rate and the concentration of the supplied salt water change, and the temperature difference among the unit cells can be kept within 1° C. or less, for example. When the cooling regulation is not conducted, the temperature differences in the columns of the maximum temperature difference among the unit cells without cooling would arise.

As explained in the section of the background art, the electrolytic temperature relates to the voltage. Influence of approximately 10 mV/° C. (an increase in the temperature of 1° C. results in a decrease in the voltage of approximately 10 mV) is an example of the relation, and operation with lower voltage (less energy) can be achieved as the temperature becomes higher. As already described above, in the conventional techniques, the upper-control limit temperature is set based on the electrolytic bath with the highest operating temperature, and the other electrolytic baths are forced to be operated at a lower electrolytic temperature. Thus, the voltages become high, and the operation efficiency decreases. In the invention, because there is almost no temperature difference among the unit cells, all the electrolytic baths can be maintained under preferable operating conditions under which low electrolytic voltages are achieved.

In the comparative examples (examples without cooling), temperature differences of 3° C. or more arose when the cooling water was stopped, and the experiment itself was inadequate because of the large temperature differences. Thus, the values were determined by calculation. In an actual case, the increases in the temperature have the effect of decreasing the voltages, and the temperature differences would be slightly smaller.

Example 3

To determine what cooling structure would be more preferable as the cooling system, the cooling effects of different cooling methods were examined using an apparatus similar to that of Example 1 but using one unit cell. The conditions c), d) and e) below were under the conditions under which the temperature of the electrolytic bath was 80° C. during cooling. The temperatures of the conditions a) and b), which are Comparative Examples, were 85° C., and the other conditions and the results are described in Table 3.

The symbols a) to e) for the methods are as follows.

a) An air-cooling method through natural airing in which air came in from the bottom and went out from the top through top and bottom holes.

b) An air-cooling method in which air was forcibly sent with a blower or the like.

c) A method in which water mist was added to a method in which air was forcibly sent. The air and the water mist were introduced from the top.

d) A method in which water was sprayed. The water was sprayed from the top and brought into contact with the entire surface.

e) Cooling water was introduced from the bottom and removed from the top.

The flow rates of air, water and cooling water and the quantities of removed heat described in Table 3 are the values per effective electrolysis area.

TABLE 3

| No. | Method | Quantity of Removed Heat [kcal/(h · m$^2$)] | Overall Heat Transfer Coefficient kcal/(h · m$^2$ · ° C.)] | Experimental Conditions |
|---|---|---|---|---|
| Example 3-1 | c | 1020 | 23 | Air 1.09 m3(N)/(h · m$^2$) Water 2 L/((h · m$^2$) |
| Example 3-2 | d | 3000 | 58 | Cooling water amount 78 L/((h · m$^2$) Cooling inlet temperature 28° C. |
| Example 3-3 | d | 1600 | 40 | Cooling water amount 40 L/((h · m$^2$) Cooling inlet temperature 28° C. |
| Example 3-4 | e | 2610 | 115 | Cooling water amount 64 L/((h · m$^2$) Cooling inlet temperature 28° C. |
| Example 3-5 | e | 2360 | 126 | Cooling water amount 100 L/((h · m$^2$) Cooling inlet temperature 51° C. |

TABLE 3-continued

| No. | Method | Quantity of Removed Heat [kcal/(h · m²)] | Overall Heat Transfer Coefficient kcal/(h · m² · ° C.)] | Experimental Conditions |
|---|---|---|---|---|
| Comparative Example 1 | a | tiny value | tiny value | |
| Comparative Example 2 | b | tiny value | tiny value | Air 1 $m^3$(N)/((h · $m^2$) |

As shown above, the methods c), d) and e) are appropriate as the cooling methods, and d) and e) are preferable. The cooling method d) did not require strict airtightness of the cooling chamber (water pressure did not apply in the cooling water chamber), and thus a large quantity of removed heat could be achieved even with a simple structure. The cooling method e) was a method in which the flow rate of the cooling water could be increased easily. Thus, even when the temperature at the cooling water inlet was made high and when the temperature difference from the internal temperature of the electrolytic bath was made small, by increasing the flow rate of the cooling water, the overall heat transfer coefficient could be maintained high, and the difference in the quantity of removed heat between the upper and lower parts of the electrolysis surface could be made small. Therefore, preferable results could be obtained. In Comparative Examples 1 and 2, the sensible heat of the air was small, and the quantities of removed heat were tiny values.

Example 4 and Comparative Example 3

Figure 10:
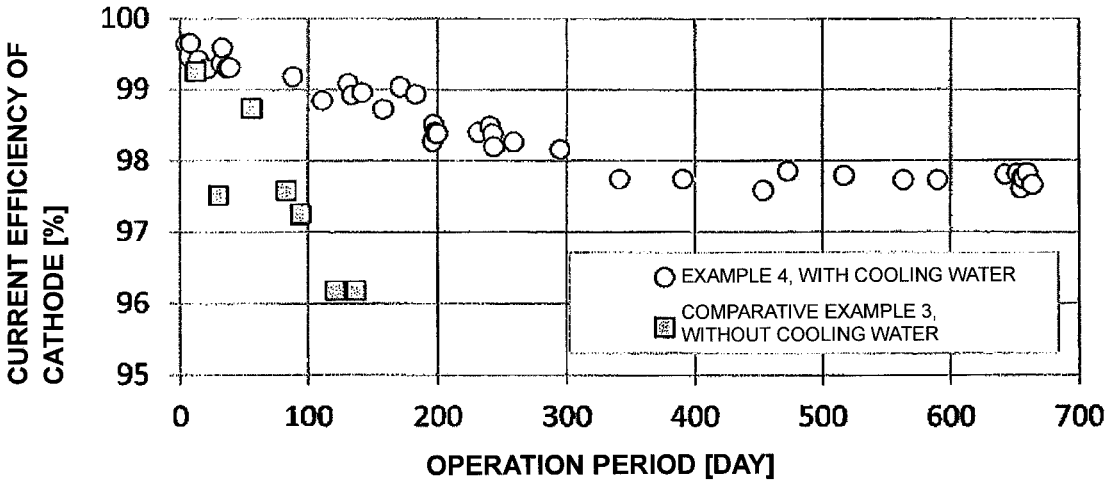
FIG. 10 is a graph showing the results of a comparative test in which the relations between the current efficiency of the cathode of the electrolytic bath and the operation period (days) were compared between the case using cooling water and the case without using any cooling water.

The same apparatus as that of Example 1 was used, and the presence or absence of the flow of the cooling water was changed. In Example 4, the temperatures of the anode chambers were 78 to 89° C., and the set temperatures at the cooling water inlets were 60° C. In Comparative Example 3, the temperatures of the anode chambers were 77 to 89° C., and the apparatus was operated without any cooling water. The operation period (days) and the changes in the current efficiency are shown in FIG. 10.

The influence, namely the decrease in the current efficiency, was smaller in Example 4, which was cooled. Almost no decrease in the current efficiency was observed on the 400th day of operation and later, and high performance could be maintained.

The invention claimed is:

1. A method for operating an apparatus for producing an alkali hydroxide, the apparatus having electrolytic cells each constructed by separating an anode chamber and a cathode chamber with an ion-exchange membrane, providing an anode in the anode chamber and providing a gas diffusion electrode in the cathode chamber, and electrolysis being conducted while an aqueous alkali chloride solution is supplied to the anode chamber and while an oxygen-containing gas is supplied to the cathode chamber, the method using:

a plurality of groups of the electrolytic cells, the plurality of groups being connected in series in a current path, the electrolytic cells within a same group being connected in parallel or series in the current path, flow passages provided to the electrolytic cells, a coolant passing through the flow passages, a flow rate adjuster provided to each electrolytic cell or each group of the electrolytic cells, the flow rate adjuster being able to adjust flow rates of the coolant, a coolant supply passage for supplying the coolant to the flow passages, a pressure-adjusting valve and a pressure detector placed at an upstream part of a branch part in the coolant supply passage, the branch part being a part at which the coolant supply passage is branched corresponding to the plurality of groups of the electrolytic cells, and a heat exchanger placed at the upstream part of the branch part, the method comprising:

adjusting a temperature of the coolant to a set temperature by the heat exchanger, cooling the electrolytic cells by passing the coolant through the flow passages, adjusting flow rates of the coolant passing through the flow passages individually in each electrolytic cell or in each group of the electrolytic cells by the flow rate adjuster, providing a set pressure value of the coolant based on an electrolytic current density and a stored predetermined relation between the electrolytic current density and the set pressure value of the coolant, the electrolytic current density being provided based on a detected value of a current supplied to the plurality of groups of the electrolytic cells, and adjusting a degree of opening of the pressure-adjusting valve based on a difference between the set pressure value and a pressure value measured by the pressure gauge.

2. The method for operating an apparatus for producing an alkali hydroxide according to claim 1, wherein each of the flow passages through which the coolant passes is provided on a wall side facing at least one of the gas diffusion electrodes across a respective one of the cathode chambers.

3. The method for operating an apparatus for producing an alkali hydroxide according to claim 1, wherein the flow rate adjuster is provided to each group of the electrolytic cells connected in parallel in the current path, or each of the electrolytic cells connected in series.

4. The method for operating an apparatus for producing an alkali hydroxide according to claim 1, the method further comprising:

recovering the coolant discharged from the flow passages of the electrolytic cells in a recovery tank for recovering the coolant, recooling the coolant recovered in the recovery tank to a set temperature, and supplying the coolant recooled by the cooling unit to the flow passages.

5. The method for operating an apparatus for producing an alkali hydroxide according to claim 1, wherein a temperature of the coolant supplied to the flow passages is regulated at or higher in an operation of heating the electrolytic cells before an electrical current is applied.

6. The method for operating an apparatus for producing an alkali hydroxide according to claim 1, wherein when an operation of the electrolytic cells is stopped by shutting off the electrical current, a supply of the coolant is continued, and a supply temperature of the coolant is regulated at 60° C. or lower.

7. A method for operating an apparatus for producing an alkali hydroxide, the apparatus having electrolytic cells each constructed by separating an anode chamber and a cathode chamber with an ion-exchange membrane, providing an anode in the anode chamber and providing a gas diffusion electrode in the cathode chamber, and electrolysis being conducted while an aqueous alkali chloride solution is supplied to the anode chamber and while an oxygen-containing gas is supplied to the cathode chamber, the method using:

a plurality of groups of the electrolytic cells, the plurality of groups being connected in series in a current path, the electrolytic cells within a same group being connected in parallel or series in the current path, flow passages configured such that a coolant passes therethrough and the coolant is placed on a back-surface side of a wall facing the ion-exchange membrane across the cathode chamber, a flow rate adjuster provided to each electrolytic cell or each group of the electrolytic cells, the flow rate adjuster being able to adjust flow rates of the coolant, a coolant supply passage for supplying the coolant to the flow passages, a pressure-adjusting valve and a pressure detector placed at an upstream part of a branch part in the coolant supply passage, the branch part being a part at which the coolant supply passage is branched corresponding to the plurality of groups of the electrolytic cells, and a heat exchanger placed at the upstream part of the branch part, the method comprising:

adjusting a temperature of the coolant to a set temperature by the heat exchanger, cooling the electrolytic cells by passing the coolant through the flow passages, adjusting flow rates of the coolant passing through the flow passages individually in each electrolytic cell or in each group of the electrolytic cells by the flow rate adjuster, providing a set pressure value of the coolant based on an electrolytic current density and a stored predetermined relation between the electrolytic current density and the set pressure value of the coolant, the electrolytic current density being provided based on a detected value of a current supplied to the plurality of groups of the electrolytic cells, and adjusting a degree of opening of the pressure-adjusting valve based on a difference between the set pressure value and a pressure value measured by the pressure gauge.

* * * * *